US006228188B1

(12) United States Patent
Meersschaut et al.

(10) Patent No.: US 6,228,188 B1
(45) Date of Patent: May 8, 2001

(54) HEAT TREATMENT OF A STEEL WIRE

(75) Inventors: Dirk Meersschaut, Wielsbeke; Godfried Vanneste, Ingelmunster, both of (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 08/278,910

(22) Filed: Jul. 22, 1994

Related U.S. Application Data

(63) Continuation of application No. 07/902,359, filed on Jun. 22, 1992, now abandoned.

(30) Foreign Application Priority Data

Jul. 22, 1991 (EP) ..... 91201917

(51) Int. Cl.[7] ..... C12D 9/52

(52) U.S. Cl. ..... 148/595; 148/596; 148/598; 148/599

(58) Field of Search ..... 148/595, 596, 148/600, 598, 599

(56) References Cited

U.S. PATENT DOCUMENTS

| | | | |
|---|---|---|---|
| 2,756,169 | 7/1956 | Corson et al. | 148/595 |
| 3,669,762 | 6/1972 | Takeo et al. | 148/596 |
| 3,735,966 | 5/1973 | Hoffmann | 266/102 |
| 4,722,210 | 2/1988 | Bourgois et al. | 72/58 |
| 4,767,472 | 8/1988 | Vanneste | 148/596 |
| 4,788,394 | 11/1988 | Vanneste et al. | 219/636 |

FOREIGN PATENT DOCUMENTS

| | | |
|---|---|---|
| 2300810 | 9/1976 | (FR) . |
| 1-201592 | 8/1989 | (JP) . |
| 91/00368 | 1/1991 | (WO) . |

OTHER PUBLICATIONS

Mason et al., "The Use of Polymer Quenchants for the Patenting of High–Carbon Steel Wire and Rod", *Heat Treatment of Metals*, pp. 77–83, (1982).

*Primary Examiner*—Sikyin Ip
(74) *Attorney, Agent, or Firm*—Foley & Lardner

(57) ABSTRACT

A process of patenting at least one steel wire (10) with a diameter less than 2.8 mm. The cooling is alternatingly done by film boiling in water (14, 16) during one or more water cooling periods and in air during one or more air cooling periods. A water cooling period immediately follows an air cooling period and vice versa. The number of the water cooling periods, the number of the air cooling periods, the length of each water cooling period are so chosen so as to avoid the formation of martensite or bainite.

16 Claims, 2 Drawing Sheets

HEAT TREATMENT OF A STEEL WIRE

This application is a continuation of application Ser. No. 07/902,359, filed Jun. 22, 1992, now abandoned.

BACKGROUND OF THE INVENTION

The present invention relates to a process of heating and subsequently cooling at least one steel wire. An example of such a process is austenitizing the steel wire and subsequently cooling the steel wire to allow transformation from austenite to pearlite.

The term "steel wire" refers in what follows to a large range of carbon steel wires where transformation from austenite to pearlite may occur. A typical composition may be along the following lines:

a carbon content between 0.10% and 0.90%, preferably between 0.60% and 0.85%, a manganese content between 0.30% and 1.50%, a silicon content between 0.10 and 0.60%, maximum sulphur and maximum phosphorus contents of 0.05%. Other elements such as chromium, nickel, vanadium, boron, aluminium, copper, molybdenum, titanium may also be present; either alone or in combination with another element. The balance of the steel composition is always iron. All percentages expressed herein are percentages by weight.

The steps of heating the steel wire above the austenitizing temperature and subsequently cooling the steel wire to a temperature between 500° C. and 680° C. to allow transformation from austenite to pearlite are widely known and are commonly called patenting. Patenting is done to obtain an intermediate wire product (a so-called half-product, in contradistinction to a final product) with a metallic structure which allows further drawing without difficulties. The exact metallic structure of the patented steel wire as an intermediate wire product not only determines the absence or presence of wire fractures during the subsequent wire drawing but also determines to a large extent the mechanical properties of the steel wire at its final diameter.

In this way transformation conditions must be such that martensite or bainite are avoided even at very local spots on the steel wire surface. On the other hand, the metallic structure of the patented steel wire must not be too soft, i.e. it must not present too coarse a pearlite structure or too great a quantity of ferrite, since such a metallic structure would never yield the desired ulitmate tensile strength of the steel wire at its final diameter.

It follows that the second step of the patenting process, i.e. the cooling or transformation step, is very critical. Temperature ranges and cooling velocities must be so that the desired intermediate wire product is obtained.

The prior art has provided a plurality of ways to perform the transformation step, all of these ways having serious drawbacks.

Transformation may be done by means of a lead bath or of a salt bath. These embodiments have the advantage of giving the patented steel wire a proper metallic structure. Both require, however, considerable running costs. Moreover, both cause considerable environmental problems. And lead drag out brings about quality problems in the downstream processing steps.

Transformation may also be done in a fluidized bed. A fluidized bed may also give the patented steel wire a proper metallic structure. The investments needed for a fluidized bed installation are very high and the running and operating costs are even higher than for a lead bath. Moreover, fluidized bed installations may have a lot of maintenance problems.

Austenite to pearlite transformation may also be done in a water bath. A water bath has the advantage of low investment costs and low running costs. Water patenting, however, may give problems for wire diameters smaller than 2.8 mm and even becomes impossible for wire diameters smaller than about 1.8 mm.

SUMMARY OF THE INVENTION

It is an object of the present invention to avoid the drawbacks of the prior art.

It is a further object of the present invention to provide with a transformation process which has low investment costs, low running costs and which does not require much maintenance.

It is another object of the present invention to provide with a transformation process which gives patented steel wires with a proper metallic structure.

It is yet another object of the present invention to provide with a process which is suitable for transformation of steel wires with a diameter smaller than 2.8 mm, e.g. smaller than 1.8 mm.

According to the present invention, there is provided a process of heating and subsequently cooling at least one steel wire. The steel wire has a diameter which is less than 2.8 mm, e.g. less than 2.3 mm or less than 1.8 mm. The cooling is alternatingly done by film boiling in water during one or more water cooling periods and in air during one or more air cooling periods. A water cooling period immediately follows an air cooling period and vice versa. The number of the water cooling periods, the number of the air cooling periods, the length of each water cooling period and the length of each air cooling period are so chosen so as to avoid the formation of martensite or bainite.

The term "film boiling" refers to the stage of cooling by means of water, during which the steel wire is surrounded by a continuous and stable vapour film. This stage is characterized by a regular and relatively slow cooling.

The film boiling stage must be distinguished from two other stages which may occur during water cooling:

(i) the nucleate boiling stage where the stable vapour film disappears and where cooling is rapid and irregular;

(ii) the convective cooling stage where the water is in direct contact with the steel wires.

The stages (i) and (ii) must be avoided in the process according to the invention.

The term "water" refers to water where additives may have been added to. The additives may comprise surface active agents such as soap, polyvinyl alcohol and polymer quenchants such as alkalipolyacrylates or sodium polyacrylate (e.g. AQUAQUENCH 110®, see e.g. K. J. Mason and T. Griffin. The Use of Polymer Quenchants for the Patenting of High-carbon Steel Wire and Rod, Heat Treatment of Metals. 1982.3. pp 77–83). The additives are used to increase the thickness and stability of the vapour film around the steel wire. The water temperature is preferable above 80° C. e.g. above 85° C. most preferably above 90° C. e.g. around 95° C. The higher the water temperature, the higher the stability of the vapour film around the steel wire.

Water cooling is conveniently done in a water bath where the steel wire or steel wires are guided through via a horizontal and rectilinear path. The bath is usually of the overflow-type.

The term "water bath" refers both to a complete water bath taken as a whole and to that part of a complete water bath where the steel wire has been immersed.

It is possible to match the dimensions of the water baths to the number of steel wires so that—except for the starting up phase—energy does not need to be supplied to the water baths since the energy provided by the hot steel wires is sufficient to keep the water at the proper temperature. This reduces considerably the operating costs.

A further advantage and the working of the invention may be explained as follows.

The heat content of a wire is proportional to its volume, the volume being proportional to $d^2$, where d is the diameter of the wire:

$$\text{heat content}=C_1\times d^2$$

The surface of a wire is proportional to its diameter d:

$$\text{surface}=C_2\times d$$

As a consequence, the cooling velocity, being proportional to the surface and inversely proportional to the heat content, is inversely proportional to the diameter d:

$$\text{cooling velocity}=(C_2\times d)/(C_1\times d^2)=C_3/d$$

The smaller the diameter, the greater the cooling velocity and the greater the chances for formation of martensite or bainite.

In this way transformation in water becomes difficult for wire diameters below 2.8 mm and becomes impossible for wire diameters below about 1.8 mm. The cooling velocity is that high that even by film boiling the "nose" of the transformation curve in a TTT-diagram is passed by. The result is the formation of martensite.

The invention makes patenting of steel wires with a diameter below 2.8 mm, e.g. below 1.8 mm (1.5 mm, 1.2 mm, 0.8 mm), possible by moderating the global cooling velocity. Cooling by film boiling in water is alternated with cooling by air.

When the steel wire has been heated above the austenitizing temperature the cooling stage comprises a pre-transformation stage.

The number of the water cooling periods and the number of the air cooling periods in the pre-transformation stage, and the length of each such water cooling period and the length of each such air cooling period during the pre-transformation stage are preferably so chosen so as to start transformation from austenite to pearlite at a temperature between 550° C. and 650° C. which allows a patented steel wire with suitable mechanical properties.

Usually the pre-transformation stage consists of only one water cooling period and of only one subsequent air cooling period. During this water cooling period the steel wire is initially cooled rapidly and this rapid cooling is slowed down during the air cooling period so as to enter the "nose" of the transformation curve at a proper place.

Relating to the transformation stage, the number of the water cooling periods and the number of the air cooling periods and the length of such water cooling periods and the length of such air cooling periods are so chosen so as to limit the heating up of the steel wire due to recalescence to a maximum of 75° C. above the temperature where transformation has started, e.g. to a maximum of 50° C. and preferably to a maximum of 30° C. This avoids too soft a structure of the patented steel wire. The more the heating up of the steel wire due to recalescence can be limited the better.

For steel wire diameters of about 1.8 mm and more, the transformation stage may consist only of one water cooling period without an air cooling period. The complete transformation from austenite to pearlite occurs in a water bath. Cooling in the post-transformation stage may be done in air.

For wire diameters which are substantially smaller than 1.8 mm, the water cooling during transformation may be too fast so that, despite the recalescence heat, bainite or martensite risks to be formed. In this case, a water cooling period must be alternated with an air cooling period, and, by way of example, the transformation phase may consist of a first air cooling period, followed by a water cooling period and followed again by an air cooling period.

In extreme cases, for very small diameters, the need for a water cooling period during the transformation stage may even be non-existent. Cooling in air during transformation suffices to limit the heating up due to the recalescence phenomenon.

Preferably the cooling by air or in air is not a forced air cooling but a simple cooling in ambient air.

After the patenting treatment the steel wire may be subject to other downstream processing steps.

If the steel wire is to be used as a reinforcement of an elastomeric material, such as rubber, following downstream processing steps may occur:

(i) plating with a brass alloy or plating with a zinc alloy;

(ii) cold drawing to a final diameter smaller than 0.60 mm, e.g. smaller than 0.40 mm or 0.30 mm;

(iii) twisting the steel wires into a steel cord;

(iv) embedding the steel cord into an elastomeric material such as a tire ply (breaker or carcass ply), a rubber hose, a conveyor belt ply or a timing belt ply.

As a first alternative embodiment of the invention, the number of water cooling periods, the number of air cooling periods, the length of each water cooling period and the length of each air cooling period are so chosen to follow a predetermined cooling curve, called herein a predetermined temperature versus time curve.

Relating to the pre-transformation stage, the number of water cooling periods, the number of air cooling periods and the length of each such water cooling period and each such air cooling period are so chosen so as to obtain a predetermined average cooling velocity.

Relating to the transformation stage, the number of water cooling periods (if any) and the number of air cooling periods (if any), and the length of each such water cooling period and the length of each such air cooling period may be so chosen so as to obtain a substantially isothermal transformation.

As a second alternative embodiment of the invention, the number of water cooling periods, the number of air cooling periods, the length of each eater cooling period and the length of each air cooling period are so chosen so as to obtain predetermined mechanical properties (tensile strength . . . ) of the steel wire.

BRIEF DESCRIPTION OF THE DRAWINGS

The invention will now be further explained with reference to the accompanying drawings wherein.

DETAILED DESCRIPTION OF THE PREFERRED EMBODIMENTS

Figure 1:
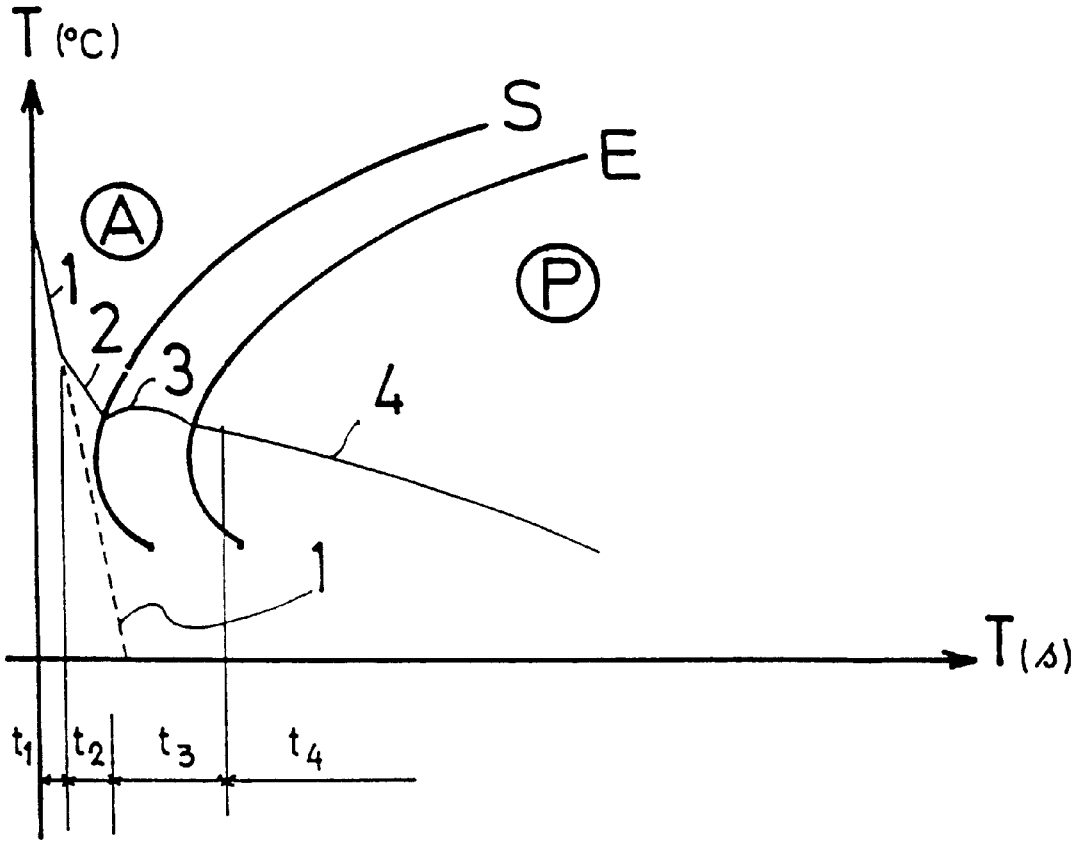
FIG. 1 shows a cooling curve of a process according to the present invention.

FIG. 1 shows a cooling curve 1–4 in a so-called TTT-diagram (Temperature-Time-Transformation). Time is presented in abscissa and temperature forms the ordinate. S is the curve which designates the start of the transformation from austenite (A) to pearlite (P), E is the curve which designates the end of this transformation.

A steel wire with a diameter of about 1.50 mm which is cooled by film boiling in a overflow water bath follows both the full line and subsequently the dotted lines of the cooling curve 1. The dotted lines of cooling curve 1 pass by the transformation curve S. The result is a steel wire with a martensite structure.

In order to avoid this in a process according to the invention, film boiling is interrupted after a first water cooling period $t_1$ and is cooled in ambient air during a second air cooling period $t_2$. Curve 2 is the cooling curve during this second time period. Preferably, there is only one water cooling period and only one air cooling period in the pre-transformation stage, although more water cooling periods and air cooling periods are possible. The length of this first water cooling period and the length of this second air cooling period are so chosen so as to enter the "nose" of the transformation curve at a suitable place, e.g. between 550° C. and 650° C. Transformation occurs in a water bath during another water cooling period $t_3$. Curve 3 is the cooling curve during transformation. Further cooling occurs in the air and is shown by cooling curve 4.

Figure 2:
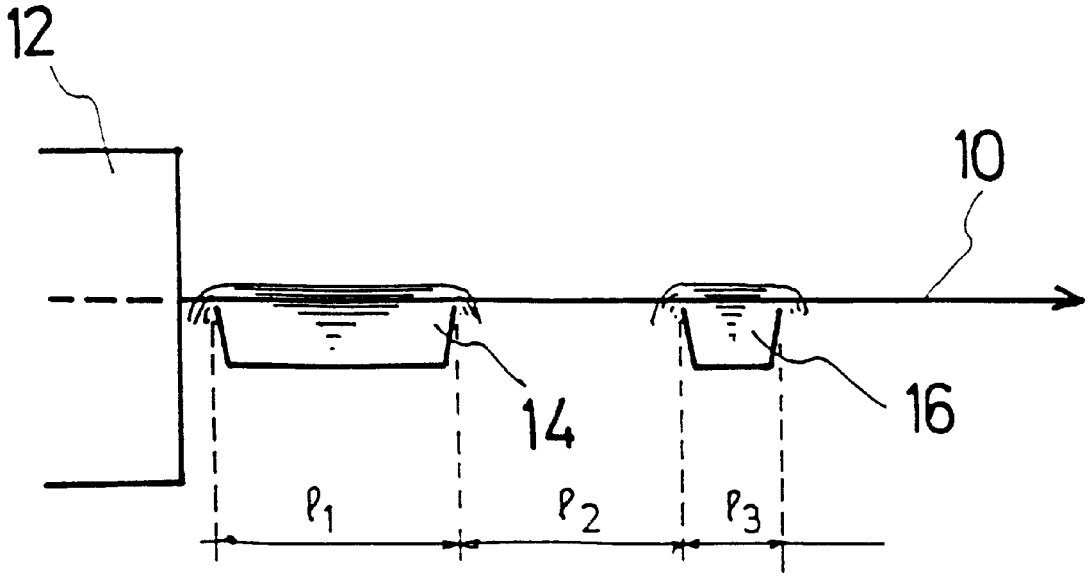
FIGS. 2, 3 and 4 give schematic representations of ways of carrying out a process according to the invention.

FIG. 2 shows schematically a way of carrying out the process according to the invention. As a matter of example, a steel wire 10 with a carbon content of 0.80% and with a diameter of 1.50 mm is led out of a furnace 12 having a temperature of about 1000° C. The wire speed is about 24 m/min. A first water bath 14 of the overflow-type is situated immediately downstream the furnace 14. The length $l_1$ of the first water bath 14 is 0.8 m. The steel wire 10 leaves the water bath 14 and is guided through the ambient air over a length $l_2$ of 0.7 m. A supplementary water bath 16 with a length $l_3$ of 0.3 m where steel wire 10 is guided through is provided. After leaving supplementary water bath 16 the steel wire 10 is cooled in ambient air.

Figure 3:
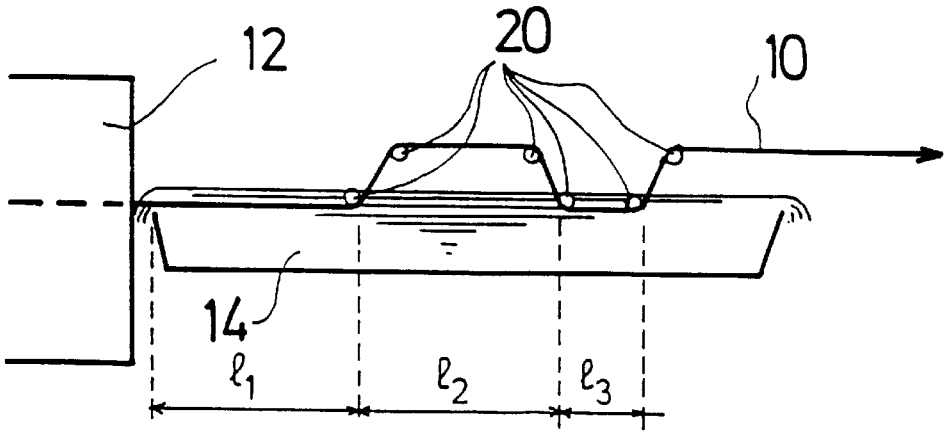

In FIG. 3 another way of carrying out the process according to the invention is shown. The main difference with the embodiment of FIG. 2 is that here only one water bath 14 is used instead of separate water baths. After a first water cooling period over a first length in the water bath 14, the steel wire 10 is guided by means of pulleys 20 out of the bath into the air during a second air cooling period over a second length. Subsequently, the steel wire 10 is guided again into the same water bath 14 by means of pulleys 20. The steel wire 10 runs in the water bath over a third length $l_3$ during another water cooling period during which transformation occurs. The transformation being completed the steel wire 10 leaves the water bath 14 and is further cooled in the air.

the advantage of the embodiment of FIG. 3 is that only one water bath is necessary, the alternating cooling by water and by air being realized by installing pulleys 20 at the appropriate places. This embodiment allows for a great flexibility especially in multiwire installations: steel wires with different diameters may be patented simultaneously. Only one bath is provided, but for each wire diameter group, guiding pulleys are fixed at appropriate places in and above the water bath.

Figure 4:
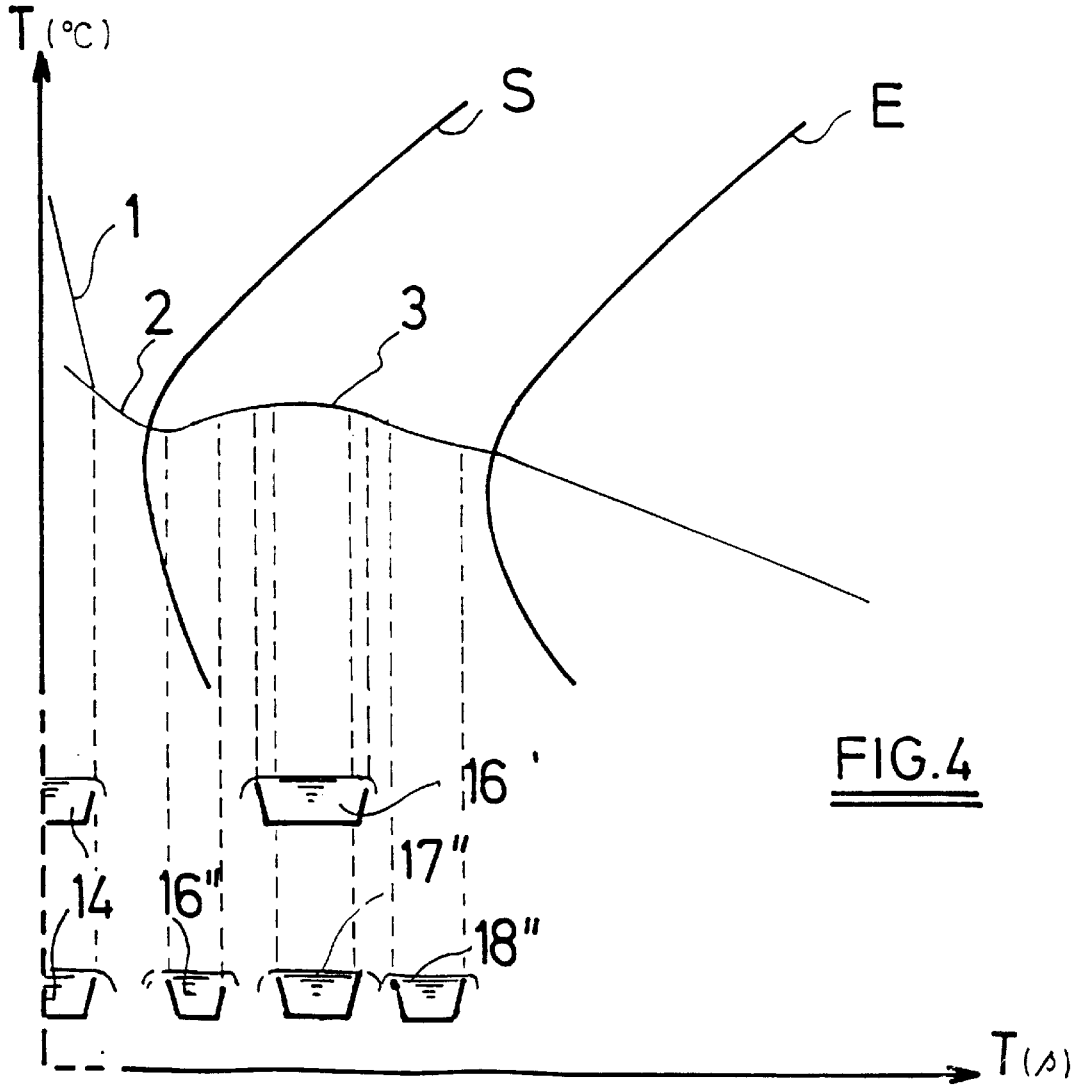

FIG. 4 shows schematically two other embodiments used for patenting steel wires with a diameter substantially smaller than 1.5 mm.

In a first embodiment only a small water bath 16' is provided for the transformation stage. Transformation has already started before the steel wire reaches this supplementary bath 16'. The function of the water bath 16' is to limit the heating up of the wire due to recalescence. The end of the transformation phase occurs in air.

In a second embodiment three relatively small water baths 16", 17" and 18" have been provided in the transformation stage. Transformation starts in air before water bath 16".

Due to the small wire diameter the cooling by film boiling is going too rapidly. In order to avoid bainite formation, water cooling is subsequently alternated with air cooling. Due to recalescence the wire temperature is increasing. This increase, however, is limited by film boiling in water bath 17". The rapid cooling in water is again slowed down by with air cooling. A third water bath 18" is used then to limit the heating up which may be initiated by recalescence during the preceding air cooling period. Once the temperature increase is under control, further cooling may again be done in the air.

Following test has been carried out on a steel wire:

carbon equivalent [=% C+0.3×(% Mn−0.40)]:0.84% wire diameter at the patenting stage: 1.70 mm patenting conditions:

- furnace temperature: 1000° C.
- temperature of the water bath: 92° C.
- time period $t_1$ in a first water bath: 2.3 s
- time period $t_2$ in air between the water baths: 1.9 s
- time period $t_3$ in a second water bath: 0.9 s final wire diameter: 0.30 mm The table hereunder summarized the results.

$R_m$ is the tensile strength of the wire at its final wire diameter, $A_g$ is the remaining elongation at the maximum load, $N_b$ is the number of bendings and $N_t$ is the number of torsions.

| sample | $R_m$ (N/mm$^2$) | $A_g$ (%) | $N_t$ | $N_b$ |
|---|---|---|---|---|
| 1 | 3150 | 0.68 | 68.8 | 16.2 |
| 2 | 3209 | 0.65 | 71.2 | 15.0 |
| 3 | 3199 | 0.63 | 69.4 | 14.8 |
| 4 | 3206 | 0.59 | 64.8 | 14.8 |
| 5 | 3215 | 0.71 | 68.6 | 13.0 |
| 6 | 3213 | 0.72 | 66.4 | 14.2 |
| 7 | 3196 | 0.67 | 68.0 | 12.2 |
| 8 | 3197 | 0.76 | 66.6 | 13.4 |
| 9 | 3189 | 0.61 | 66.2 | 13.2 |
| 10 | 3211 | 0.55 | 68.0 | 13.8 |

What is claimed is:

1. A process of manufacturing a pearlitic steel wire and avoiding formation of martensite and bainite in steel wire having a diameter which is less than 2.8 mm, comprising the steps of:

(a) heating a steel wire having a diameter which is less than 2.8 mm;

(b) cooling the steel wire from step (a) during a pre-transformation stage, including:

(1) stable film boiling the steel wire by guiding the steel wire into a water bath for a first water cooling period;

(2) cooling the steel wire in air for a first air cooling period;

(c) further cooling the steel wire from step (b) during a transformation stage, including:

(1) stable film boiling the steel wire by guiding the steel wire through a water bath for a second water cooling period; and (2) air cooling the steel wire in air for a second air cooling period.

2. The process according to claim 1, wherein a length of each water cooling period and a length of each air cooling period follows a predetermined temperature vs. time curve.

3. The process according to claim 1, further comprising at least one additional film boiling step and one additional air cooling step.

4. The process according to claim 1, wherein the first film boiling step precedes the first air cooling step.

5. The process according to claim 1, wherein the first air cooling step precedes the first film boiling step.

6. The process according to claim 1, wherein the heating step comprises heating the steel wire above an austenitizing temperature.

7. The process according to claim 1, wherein the steel wire has a diameter less than 1.8 mm.

8. The process according to claim 1, wherein the steel wire has a diameter less than 1.2 mm.

9. The process according to claim 1, further comprising the step of plating the steel wire from the transformation stage with a brass alloy.

10. The process according to claim 1, further comprising the step of plating the steel wire from the transformation stage with a zinc alloy.

11. The process according to claim 1, further comprising the step of drawing the steel wire from the transformation stage to a diameter smaller than 0.60 mm.

12. The process according to claim 11, further comprising the step of twisting a plurality of drawn steel wires into a steel cord.

13. The process according to claim 12, further comprising the step of embedding the steel cord as a reinforcing material into an elastomeric material.

14. The process according to claim 1, wherein the air cooling is done in ambient air.

15. The process according to claim 1, wherein a heating up of the steel wire due to recalescence during said transformation stage is limited to a maximum of 75° C. above a temperature where a transformation has started.

16. A process of manufacturing a pearlitic steel wire and avoiding formation of martensite and bainite in steel wire having a diameter which is 1.2 mm or less, comprising the steps of:

(a) heating a steel wire having a diameter which is 1.2 mm or less;

(b) cooling the steel wire from step (a) during a pre-transformation stage, including:

(1) stable film boiling the steel wire by guiding the steel wire into a water bath for a water cooling period; and (2) air cooling the steel wire in air for an air cooling period.

* * * * *